US012508495B1

(12) United States Patent
Petro-Roy et al.

(10) Patent No.: US 12,508,495 B1
(45) Date of Patent: Dec. 30, 2025

(54) SKI POLE HOOK

(71) Applicants: Mark Petro-Roy, Lansdale, PA (US); Peter Vellucci, Canadensis, PA (US)

(72) Inventors: Mark Petro-Roy, Lansdale, PA (US); Peter Vellucci, Canadensis, PA (US)

( * ) Notice: Subject to any disclaimer, the term of this patent is extended or adjusted under 35 U.S.C. 154(b) by 0 days.

(21) Appl. No.: 19/056,821

(22) Filed: Feb. 19, 2025

(51) Int. Cl.
*A63C 11/22* (2006.01)

(52) U.S. Cl.
CPC ..... *A63C 11/228* (2013.01)

(58) Field of Classification Search
CPC ..... A63C 11/228
See application file for complete search history.

(56) References Cited

U.S. PATENT DOCUMENTS

| | | | | | |
|---|---|---|---|---|---|
| 3,126,191 | A * | 3/1964 | Holden | F16B 2/065 403/373 | |
| 4,299,409 | A | 11/1981 | Hummel | | |
| 4,358,138 | A | 11/1982 | Laughlin | | |
| 5,083,813 | A * | 1/1992 | Adkins | A63C 11/228 280/821 | |
| 5,178,413 | A | 1/1993 | King | | |
| 5,261,699 | A | 11/1993 | Marston | | |
| 5,326,134 | A | 7/1994 | Hiser | | |
| 9,737,788 | B1 | 8/2017 | Pierce | | |
| 2023/0363518 | A1* | 11/2023 | Van Gils | A45F 5/02 | |

FOREIGN PATENT DOCUMENTS

| | | | | |
|---|---|---|---|---|
| CN | 202501111 U * | 10/2012 | | |
| DE | 19754062 B4 * | 8/2005 | H02G 3/263 | |
| DE | 202018005491 U1 * | 10/2019 | A63C 11/228 | |
| ES | 1160084 | 9/2016 | | |
| FR | 2685216 A1 * | 6/1993 | A63C 11/02 | |
| FR | 2685216 | 12/1994 | | |
| FR | 2808701 | 10/2003 | | |
| FR | 3027811 | 5/2016 | | |
| FR | 3027811 A1 * | 5/2016 | A63C 11/22 | |
| FR | 3093930 | 7/2022 | | |
| WO | 1998047583 | 10/1998 | | |
| WO | WO-2014080235 A1 * | 5/2014 | A63C 11/02 | |

OTHER PUBLICATIONS

FR-2685216-A1 English Translation (Year: 1993).*
WO-2014080235-A1 English Translation (Year: 2014).*
DE-202018005491-U1 English Translation (Year: 2019).*
FR-3027811-A1 English Translation (Year: 2016).*
DE-19754062-B4 English Translation (Year: 2005).*
CN-202501111-U English Translation (Year: 2012).*
FR-2685216-A1 (Year: 1993).*
CN-202501111-U (Year: 2012).*
DE-202018005491-U1 (Year: 2019).*
Ieki foldingclip for fixes ski sticks. Retrieved Dec. 31, 2023.

* cited by examiner

*Primary Examiner* — Michael T. Walsh
(74) *Attorney, Agent, or Firm* — Joseph E. Maenner; Maenner & Associates, LLC

(57) ABSTRACT

A ski pole hook assembly is provided. The assembly includes a clamp having an arcuate clamp body and a hook having an arcuate hook body. The arcuate clamp body has a first free end and a second free end, with an open space between the first free end and the second free end. The hook has a free hook end and an attached end defining a space, with a gap between the free hook end and the attached end. The attached end is attached to the clamp body between the first free end and the second free end.

20 Claims, 5 Drawing Sheets

SKI POLE HOOK

BACKGROUND OF THE INVENTION

Field of the Invention

The invention relates to a clip and hook assembly that can be attached to a ski pole so that the pole can be hooked onto a ski lift safety railing while a user is riding the lift.

Description of the Related Art

Currently skiers must either hold onto the poles with their hands, tuck under a leg, strap to their wrists, etc. while riding up the lift. These methods impose challenges such as discomfort, reduced dexterity or potential to lose/damage gear.

It would be beneficial to provide a lip and hook mechanism to reduce the likelihood of dropping and losing a ski pole while riding on a ski lift.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a ski pole hook assembly. The assembly includes a clamp having an arcuate clamp body and a hook having an arcuate hook body. The arcuate clamp body has a first free end and a second free end, with an open space between the first free end and the second free end. The hook has a free hook end and an attached end defining a space, with a gap between the free hook end and the attached end. The attached end is attached to the clamp body between the first free end and the second free end.

In an alternative embodiment, the assembly described above further includes a clip having a generally rectangular body with rounded corners that includes a first free clip arm and a second free clip arm, with a clip gap formed between the first free clip arm and the second free clip arm. The clamp and the hook are connected via a unitary construction and wherein the clip is releasably attachable to the clamp.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
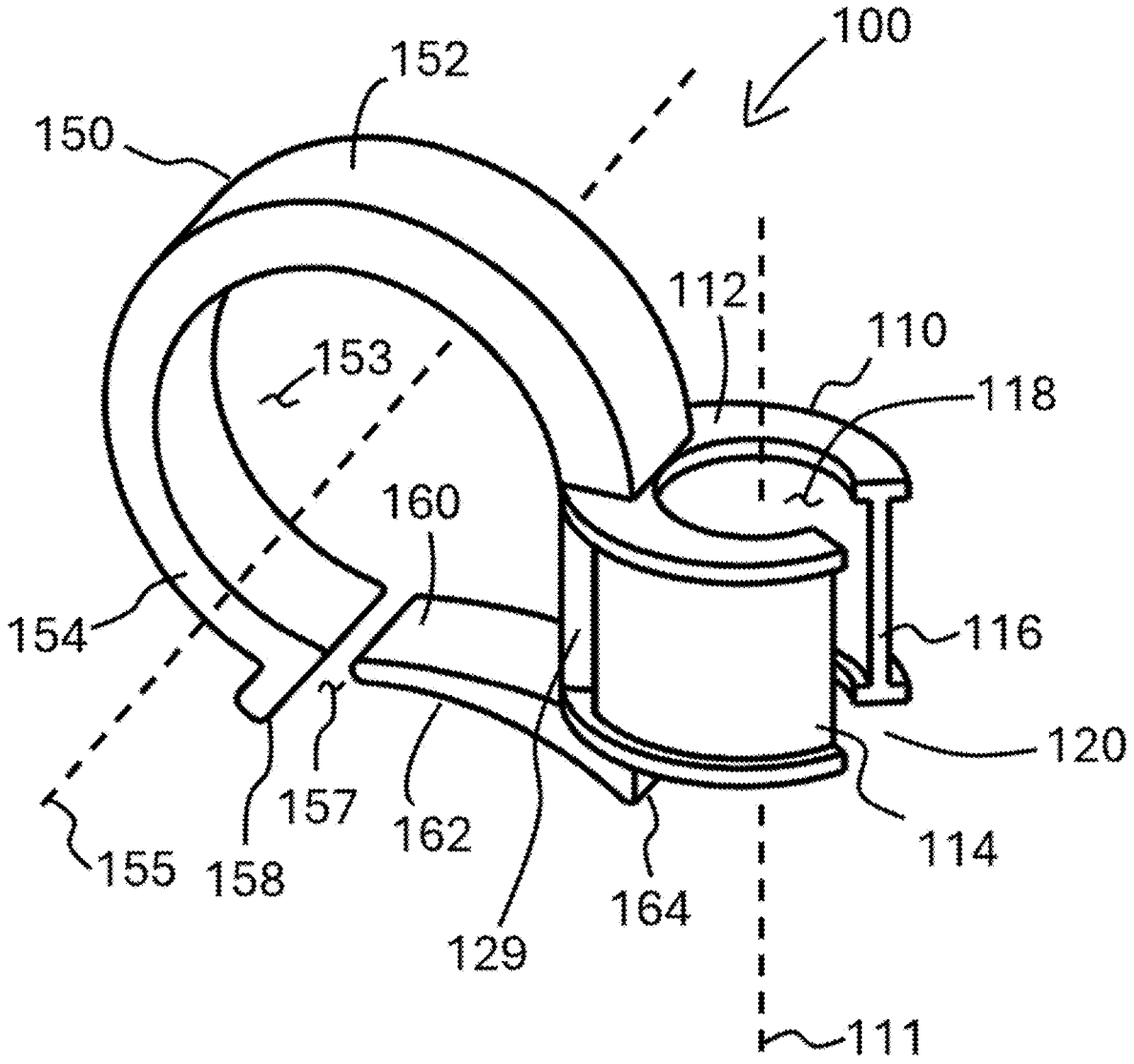
FIG. 1 is a perspective view of a ski pole hook according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Figure 2:
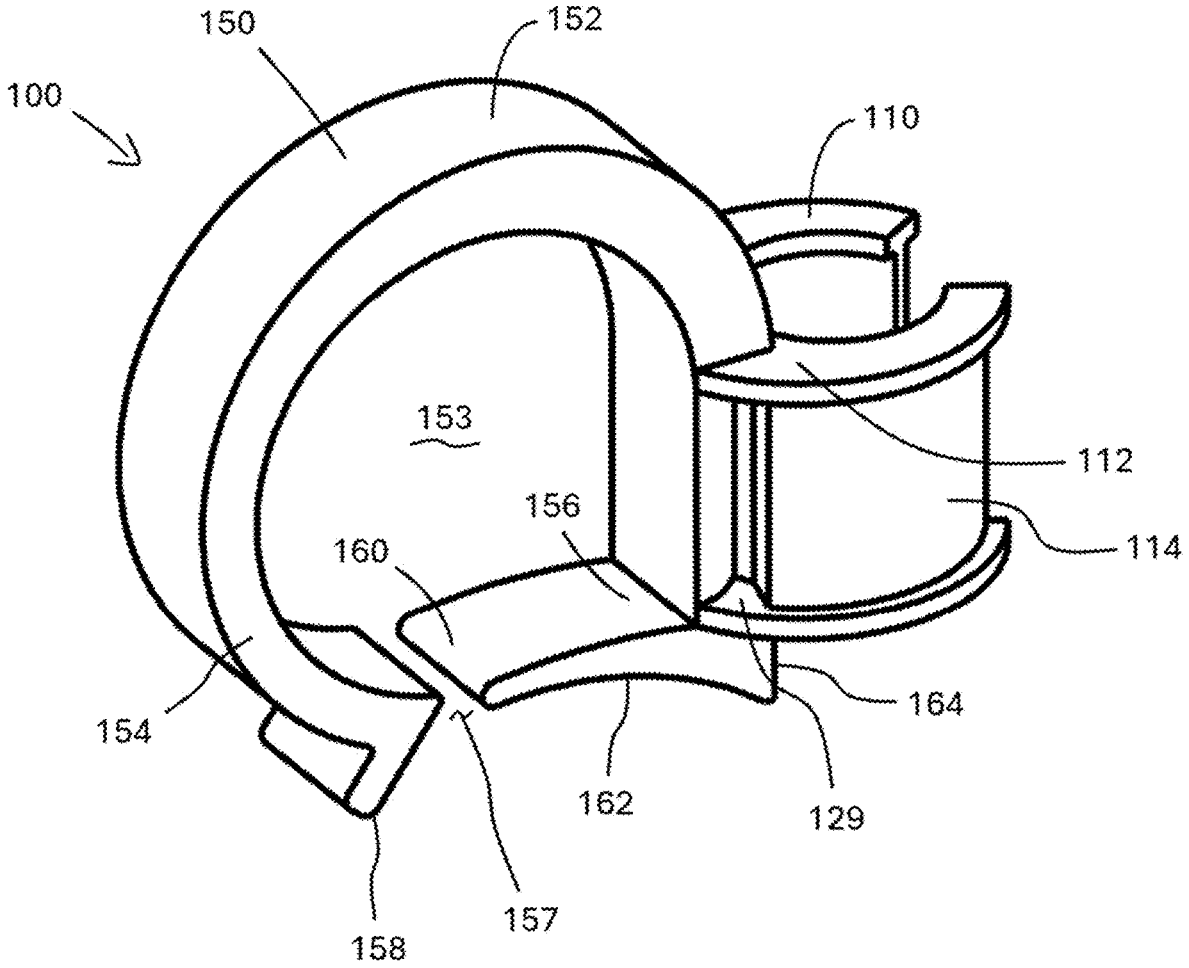
FIG. 2 is another side perspective view of the ski pole hook of FIG. 1.

Referring to FIGS. 1 and 2, the present invention provides a ski pole hook assembly 100 that allows a user to securely and easily hang ski poles from a chair lift safety bar, freeing the user's hands for other tasks. While hook assembly 100 can be used on a chair lift safety bar, those skilled in the art will recognize that hook assembly 10 can hang from other features as well. Hook assembly 100 includes a clamp 110 and a main hook 150. Both clamp 110 and hook 150 can have a plurality of mounting sizes and methods.

Assembly 100 is of unitary construction and can be manufactured via injection molding, 3-D printing, or other suitable manufacturing method. In an exemplary embodiment, assembly 100 can be constructed from a high density polymer, such as HDPE, or other suitable material. While a unitary construction is disclosed, those skilled in the art will recognize that assembly 100 can be a multi-piece construction as well.

Figure 3:
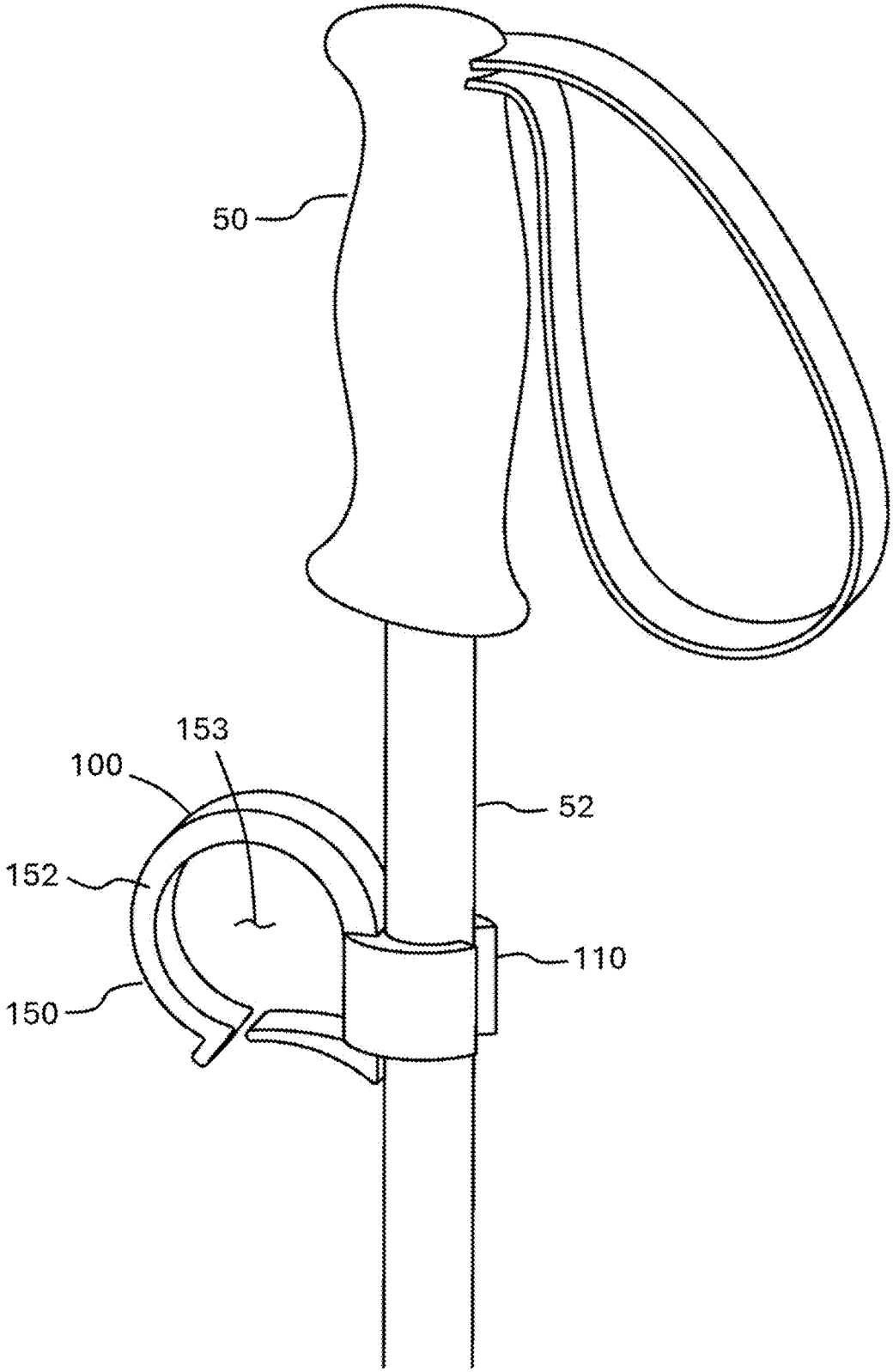
FIG. 3 is a perspective view of the hook of FIG. 1 attached to a ski pole.

Clamp 110 is adaptively and securely affixed to the pole portion 52 of a ski pole 50 having a diameter of between about 12 mm and about 18 mm, as shown in FIG. 3. Clamp includes an arcuate body 112 having a first free end 114 and a second free end 116. Body 112 extends in an arc greater than 180 degrees, but less than 360 degrees, defining a clamping space 118 that extends along a longitudinal axis 111. Optionally, a rubber grip (not shown) can be located on body 112 around clamping space 118 to help grip pole 52.

In an exemplary embodiment, body 112 defines an arc of greater than 90 degrees. In an alternative exemplary embodiment, body 112 defines an arc of greater than approximately 180 degrees. In still another alternative exemplary embodiment, body 112 defines an arc of greater than approximately 270 degrees. When pole 52 is inserted into clamp 110, pole 52 extends along axis 111. An open space 120 between free ends 114, 116 allows for insertion of ski pole 52 into clamping space 118. Free ends 114, 116 can be biased away from each other by pole 52, opening space 120 to allow pole 52 to be inserted therethrough. After pole 52 is inserted into space 118, free ends 114, 116 bias back toward each other, securing pole 52 in clamp 110.

Figure 5:
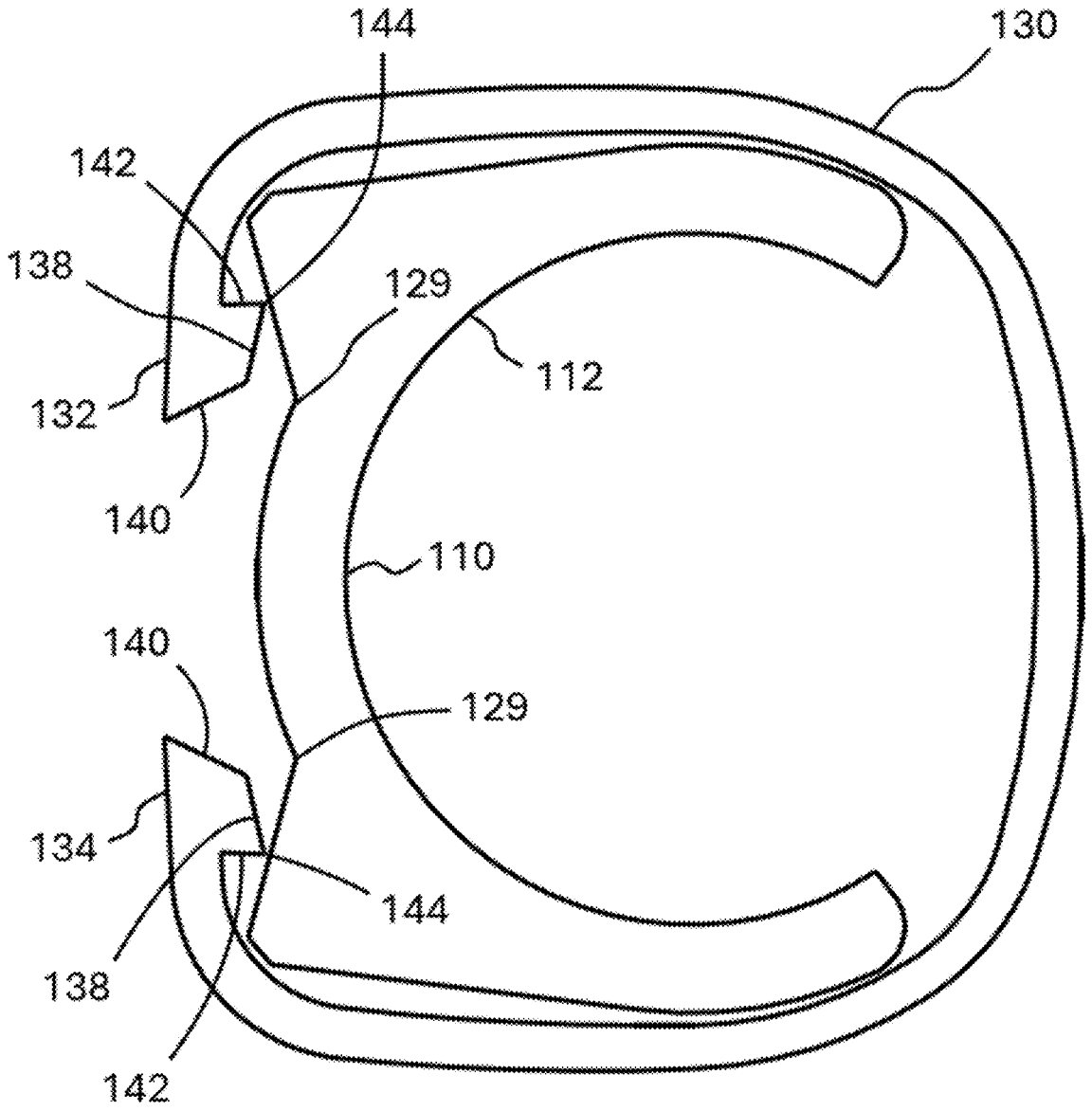
FIG. 5 is an alternative embodiment of a clamp used with the ski pole hook of FIG. 1.

Optionally, as shown in FIGS. 1, 2, and 5, clamp 110 can include recesses 129 in body 112, proximate to hook body 152.

Hook 150 is used to retain assembly 100 to a typically horizontal bar (not shown), such as is often found on a ski chair safety bar. In an exemplary embodiment, the hook 150 can accommodate a bar having between about 1"-1.5" diameter. Hook 150 includes an arcuate body 152 having a free hook end 154 and an attached end 156 defining a space 153, with a gap 157 between free hook end 154 and attached end 156. Free hook end 154 includes a lip 158 that extends away from a central axis 155 of hook 150. Axis 155 extends in a generally skew orthogonal direction relative to clamp axis 111.

Attached end 156 is attached to clamp 110 and includes a lip 160 that extends into gap 157. A bottom surface 162 of lip 160 is arcuate in shape, with a thicker profile toward clamp 110 and a thinner profile toward gap 157. An extension 164 from clamp 110 provides for the thicker profile.

When hook 150 is inserted over a safety bar or other horizontal structure, lip 158 guides the bar toward gap 157, while lip 160 deflects inward to space 153, allowing the bar to be inserted into space 153. Lip 160 then deflects back to its initial position, releasably securing hook 150 over the bar.

To remove hook 150 from the bar, one needs merely to lift hook 150 upward, deflecting lip 160 downward so that the bar can pass through gap 157.

Figure 4:
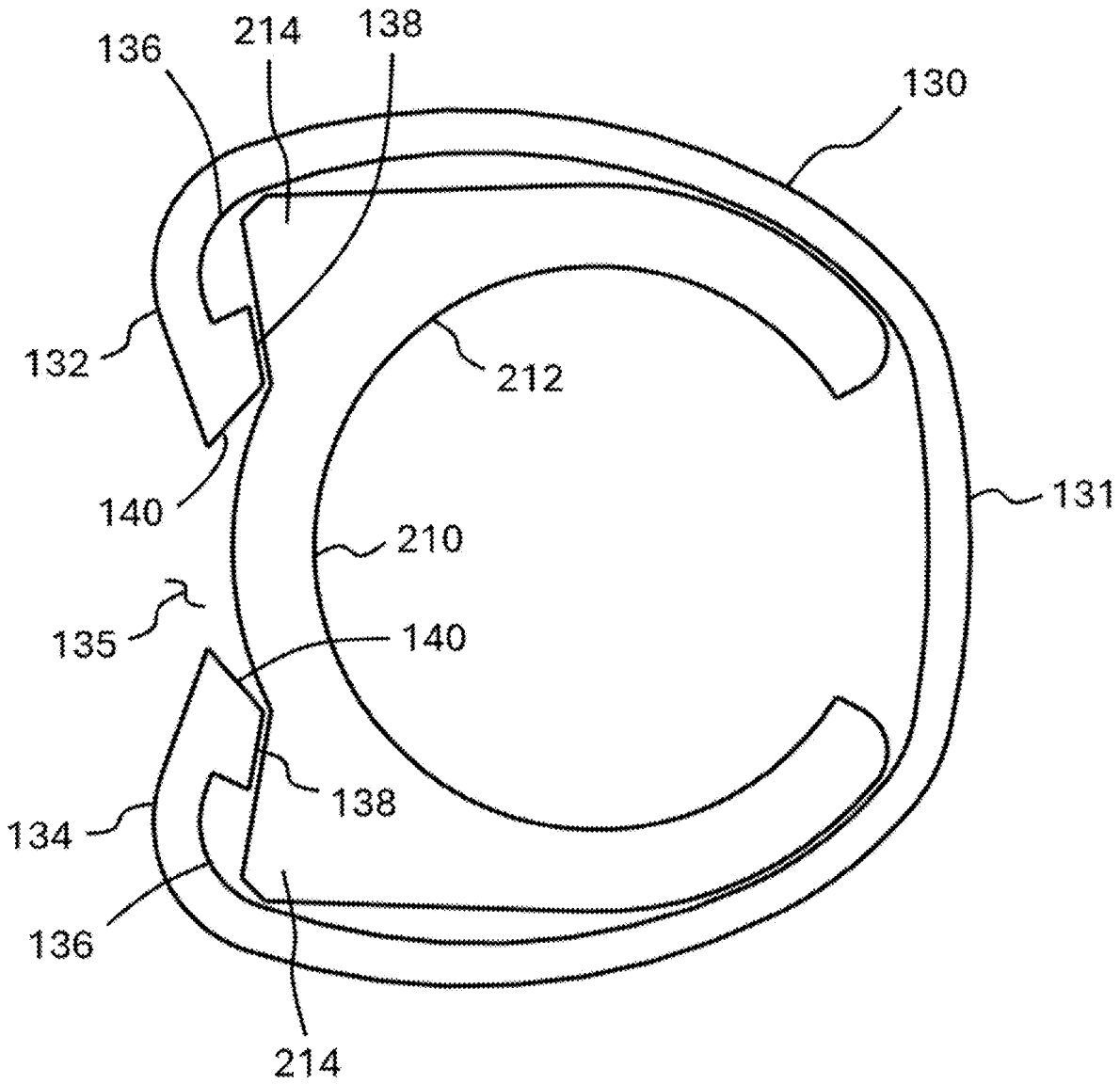
FIG. 4 is a top plan view of a clamp used with the ski pole hook of FIG. 1.

Optionally, as shown in FIGS. 4 and 5, an adapter clip 130 can be provided. Clip 130 can be constructed from the same material as assembly 100.

A clamp 210 can be mounted to the ski pole 50, as shown in FIG. 2, with clip 130 attached to clamp 210 to secure clamp 210 onto pole 50. Clip 130 maintains assembly 100 in the desired orientation on the pole 50 during use.

Clamp 210 is similar to clamp 110, but includes protrusions 214 extending outwardly from body 212 of clamp 210. Protrusions 214 extend at least about 84 degrees around clamp body 212 from each other and provide a gripping surface for clip 130.

Clip 130 has a generally rectangular body 131 with rounded corners that includes a first free arm 132 and a second free arm 134. A gap 135 is formed between free arms 132, 134. A relief 136 at the beginning of each arm 132, 134 allows arms 132, 134 to flex over clamp 210. An engagement face 138 on each arm 132, 134 engages protrusion 214 on clamp 210. An angled end face 140 on each arm 132, 134 provides a gripping surface to pull arms 132, 134 apart from each other when removing clip 130 from clamp 210. As shown in FIG. 5, arms 132, 134 can be inserted into recesses 129 in clamp 110.

Arms 132, 134 can be biased apart from each other so that arms 132, 134 can fit around clamp 110, 210. The deformation of arms 132, 134 allows clip 130 to fit over poles 50 having differing diameters, such as between about 12 mm and about 18 mm. With respect to clamp 110, as shown in FIG. 5, the backside 142 of engagement face 138 can engage clamp 110 with an edge 144. This engagement can occur when the clip 130 undergoes undue stress, giving clip 130 a second chance to remain secured to clamp 110 before unintended release.

In some embodiments the main hook 150 may be constructed from multiple sections, pivoting or hinging to comply with the mounting bar. In an alternative embodiment, instead of a hook, an enclosed feature to fully contain the mounting area can be provided. In some embodiments the main hook 150 may have a collapsing or pivoting storage position to minimize size or visual impact while not in use. In some embodiments the clamp 110 may employ zip ties, hook and loop fasteners, or other means to secure to the ski pole 50. In some embodiments the clamp 110 may employ a form of adhesive, rather than a clip 130 to mount to the ski pole 50.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A ski pole hook assembly comprising:

a clamp having an arcuate clamp body, the arcuate clamp body having a first free end and a second free end, with an open space between the first free end and the second free end; and a hook having an arcuate body, the hook having a free hook end and an attached end defining a space, with a gap between the free hook end and the attached end, wherein the attached end is attached to the clamp body between the first free end and the second free end, wherein the attached end comprises a lip extending into the gap more than half the distance between the attached end and the free hook end.

2. The ski pole hook assembly according to claim 1, wherein the clamp body extends along a clamp axis and wherein the hook extends along a hook axis in a skew orthogonal direction relative to the clamp axis.

3. The ski pole hook assembly according to claim 2, wherein the free hook end comprises a lip that extends away from hook axis.

4. The ski pole hook assembly according to claim 1, wherein the clamp further comprises an extension defining the thicker profile.

5. The ski pole hook assembly according to claim 1, wherein the clamp and the hook are of unitary construction.

6. The ski pole hook assembly according to claim 1, wherein the arcuate clamp body extends in an arc greater than 180 degrees and less than 360 degrees.

7. The ski pole hook assembly according to claim 1, wherein the hook defines an arc of greater than approximately 270 degrees.

8. The ski pole hook assembly according to claim 1, wherein the open space is sized to allow a ski pole shaft to be inserted therethrough.

9. The ski pole hook assembly according to claim 8, wherein the first free end and the second free end are configured to be biased away from each other by the ski pole shaft to allow the ski pole shaft to be inserted therethrough.

10. The ski pole hook assembly according to claim 1, further comprising a clip having a generally rectangular body with rounded corners that includes a first free clip arm and a second free clip arm, with a clip gap formed between the first free clip arm and the second free clip arm.

11. The ski pole hook assembly according to claim 10, wherein the clip further comprises a relief provided at the beginning of each clip arm such that each relief allows a respective clip arm to flex over the clamp.

12. The ski pole hook assembly according to claim 10, wherein the clamp comprises a pair of spaced protrusions between the first free end and the second free end, and wherein each clip arm comprises an engagement face, such that each clip arm engages one of the protrusions.

13. The ski pole hook assembly according to claim 12, wherein each engagement face comprises a backside having an edge, wherein the edge is configured to engage the clamp.

14. The ski pole hook assembly according to claim 10, wherein each of the first free clip arm and the second free clip arm comprises an angled end face.

15. The ski pole hook assembly according to claim 10, wherein the clamp body comprises a recess and wherein one of the first free clip arm and the second free clip arm is configured for insertion into the recess.

16. The ski pole hook assembly according to claim 15, wherein the recess is located proximate to the hook.

17. The ski pole hook assembly according to claim 10, wherein the first free clip arm and the second free clip arm are configured to be biased apart from each other such that the clip arms fit around the clamp.

18. A ski pole hook assembly comprising:

a clamp having an arcuate clamp body, the arcuate clamp body having a first free end and a second free end, with an open space between the first free end and the second free end;

a hook having an arcuate body, the hook having a free hook end and an attached end defining a space, with a gap between the free hook end and the attached end, wherein the attached end is attached to the clamp body between the first free end and the second free end;

and a clip having a generally rectangular body with rounded corners that includes a first free clip arm and a second free clip arm-, with a clip gap formed between the first free clip arm and the second free clip arm, wherein each of the first free clip arm and the second free clip arm further comprises an angled end face, an engagement face extending from the angled end face, the engagement face configured for engagement with the clamp, and a free face extending from the engagement face, the free face configured for non-engagement with the clamp, wherein the clip is releasably attachable to the clamp.

19. The ski pole hook assembly according to claim 3, wherein the lip further comprises an extension extending downwardly from the clamp.

20. A ski pole hook assembly comprising:

a clamp having an arcuate clamp body, the arcuate clamp body having a first free end and a second free end, with an open space between the first free end and the second free end; and an asymmetrical hook having an arcuate body, the hook having a free hook end and an attached end defining a space, with a gap between the free hook end and the attached end, wherein the attached end is attached to the clamp body between the first free end and the second free end, wherein the free hook end comprises a lip that extends away from hook axis, wherein the lip further comprises an extension extending downwardly from the clamp.

* * * * *